US005390849A

United States Patent [19]

Frissard

[11] Patent Number: 5,390,849

[45] Date of Patent: Feb. 21, 1995

[54] APPARATUS FOR MAIL TRANSFER

[76] Inventor: Jacques P. Frissard, 17 rue G. Peri, 92320 Chatillon, France

[21] Appl. No.: 30,111

[22] PCT Filed: Jul. 17, 1992

[86] PCT No.: PCT/FR92/00704

§ 371 Date: Mar. 11, 1993

§ 102(e) Date: Mar. 11, 1993

[87] PCT Pub. No.: WO93/02601

PCT Pub. Date: Feb. 18, 1993

[30] Foreign Application Priority Data

Jul. 29, 1991 [FR] France ..... 91 09607

[51] Int. Cl.[6] ..... B65G 11/04

[52] U.S. Cl. ..... 232/45

[58] Field of Search ..... 232/45, 46

[56] References Cited

U.S. PATENT DOCUMENTS

| | | | |
|---|---|---|---|
| 336,038 | 2/1886 | Cutler | 232/45 |
| 459,974 | 9/1891 | Cutler | 232/45 |
| 930,936 | 8/1909 | Burris | 232/45 |
| 947,843 | 2/1910 | Page | 232/45 |
| 1,423,251 | 7/1922 | Pennig . | |
| 1,423,257 | 6/1922 | Richardson . | |
| 1,539,929 | 6/1925 | Arial | 232/45 |
| 1,583,168 | 5/1926 | Pennig | 232/45 |
| 1,707,049 | 3/1929 | Cohan . | |
| 1,819,790 | 8/1931 | Redrup et al. | 232/46 |
| 3,880,344 | 4/1975 | Earle | 232/45 |
| 4,724,999 | 2/1988 | Fitzgerald et al. | 232/45 |
| 4,895,300 | 1/1990 | Hammons et al. | 232/45 |
| 5,096,115 | 3/1992 | Hassan | 232/45 |

*Primary Examiner*—Michael J. Milano
*Attorney, Agent, or Firm*—Foley & Lardner

[57] ABSTRACT

An apparatus for mail transfer including a hood including a vertical elongated slot defining an axis of the slot to receive mail and a mobile shutter to protect the mail against rain; an elongated mail transfer conduit connected to the hood defining an axis of the conduit that is substantially parallel to the axis of the slot; a receiving box connected to the mail transfer conduit; a deflector connected to the receiving box; and a receiving plate located in the receiving box.

7 Claims, 3 Drawing Sheets

APPARATUS FOR MAIL TRANSFER

BACKGROUND OF THE INVENTION

The present invention relates to an apparatus with a big vertical slot for mail transfer to a distant receiving box.

The conventional or specific letter-boxes approved by the Post-Office have traditionaly had horizontal slots with a breadth of two centimeters to about three centimeters. These letter-boxes do not fit well on fences with generally vertical openings (palisade, grille, door or main gate). The apparatus according to the invention allows a solution to this disadvantage.

SUMMARY OF THE INVENTION

This problem is solved by the hood of the apparatus according to the invention having a vertical slot which fits easily on the above described fences and which receives vertically the mail parcel. The apparatus also includes a mail transfer conduit-slide-deflector which guides a mail parcel to the receiving box and reduces its speed. A receiving plate, inside the receiving box, receives the mail more than an arm's length from the vertical slot. The present invention also includes an elastic suspension for the receiving plate to absorb the shock of the parcel landing on this plate.

According to various particular configurations of manufacture:

- the protection against the rain is ensured either by a mobile shutter mounted on the hood which can be lifted easily or by an overhang from the hood or by the receiving extension of the top wall and both lateral walls of the hood,
- the mail transfer conduit can be constitued by the extension of lateral walls of the hood,
- when the free falls are not dangerous for the mail, slide, deflector, receiving plate and elastic suspension of the receiving plate are not necessary.

In the following,an embodiment of the invention is explained in more detail with the aid of drawings.

DETAILED DESCRIPTION OF THE INVENTION

Figure 1:
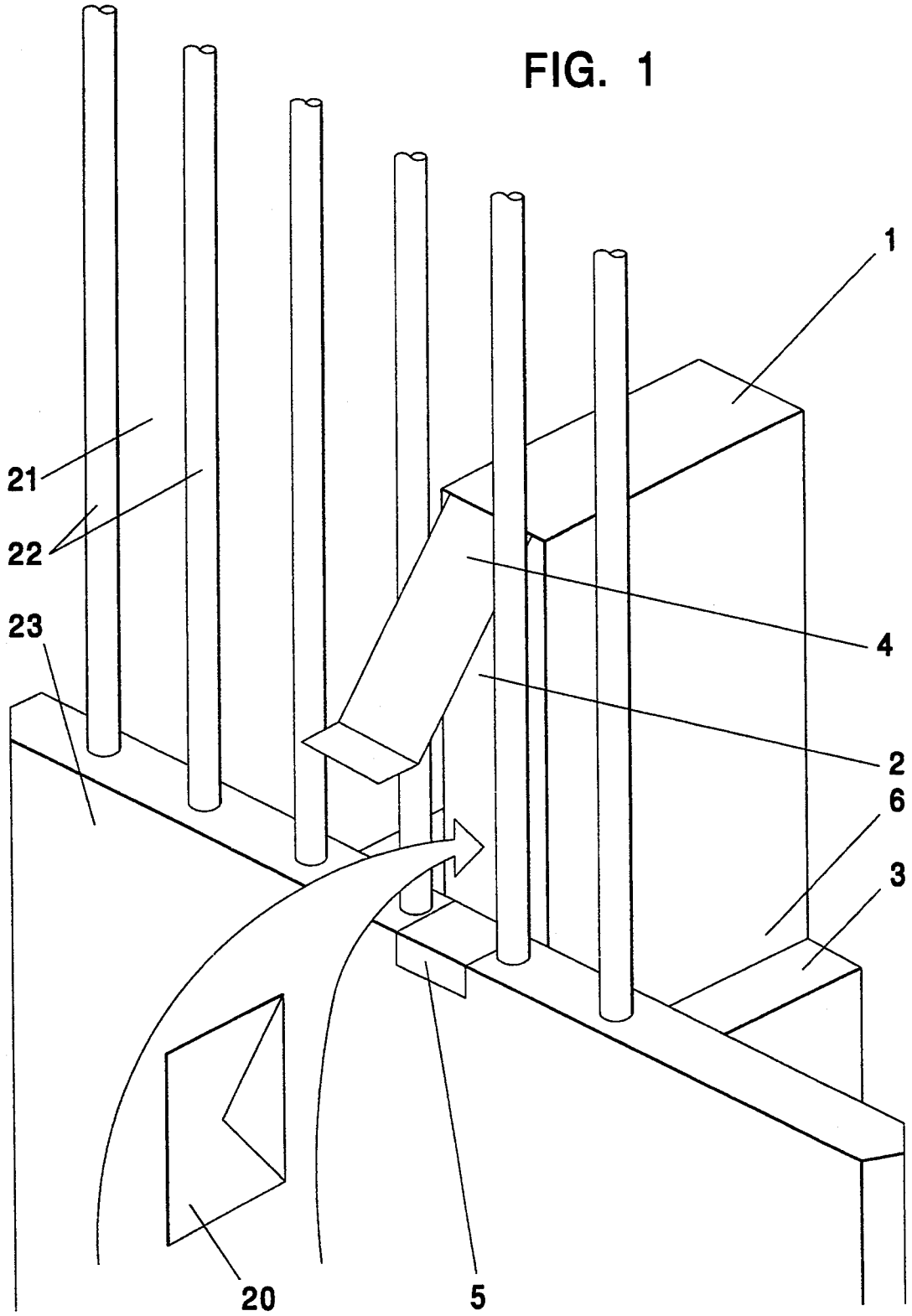
FIG. 1 shows a perspective view of the hood mounted on a grille of a gate.
Figure 2:
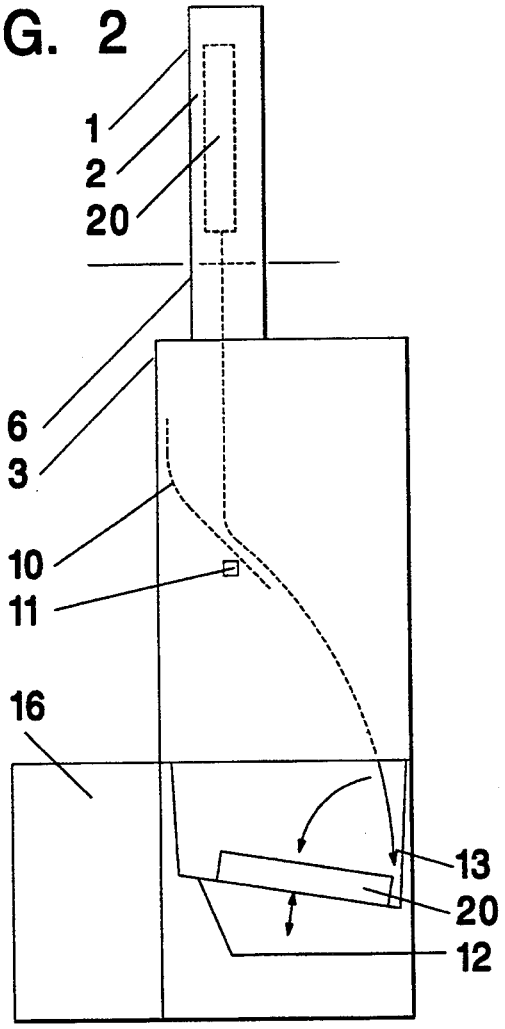
FIG. 2 shows a rear view of the apparatus according to the invention with the receiving plate in an upper position of minimum volume (open door).

The apparatus, illustrated by these drawings, includes a hood 1 (with vertical slot 2) that communicates with the receiving box 3 by means of the mail transfer conduit 6. The hood 1 and its mobile shutter 4 shelter the mail from the rain. The whole of the vertical slot mailbox is hung from gate panel 23 by means of a fixation 5 on the gate. The slot 2 is placed before an opening 21 between two bars 22 of the grille of the gate. The receiving box 3 and the mail transfer conduit 6 are bound by a belt 7. The mail transfer conduit 6 slide 10 deflector 11 guides the mail 20 to the receiving plate 12 which is hung by elastic suspension 13. The thick wall 15 (thickness $\gamma$) is the wall which is supporting the door 16 of the vertical slot mailbox. The other walls are thin (thickness $\beta$). Two carrying handles 17 allow a person to manipulate the receiving box 3.

Figure 4:
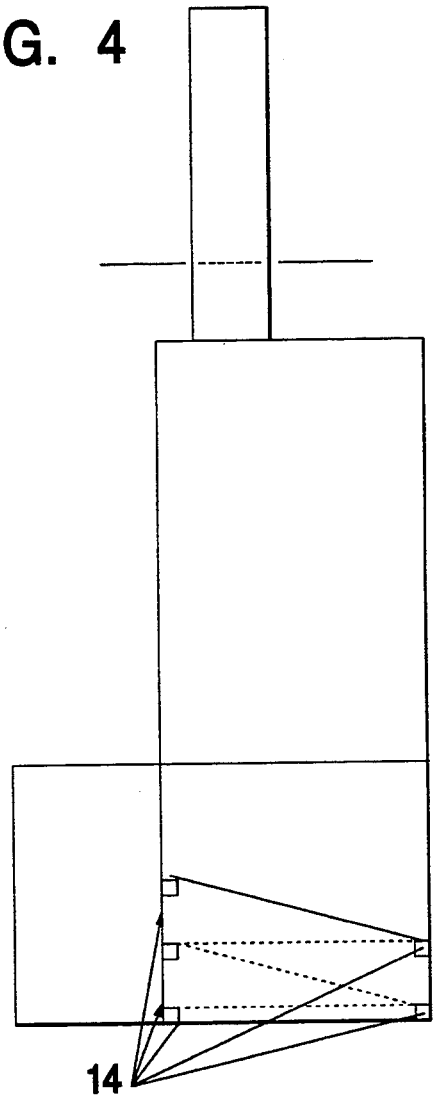
FIG. 4 shows a rear view of variant with a receiving plate placed on fixed bearing points.
Figure 3:
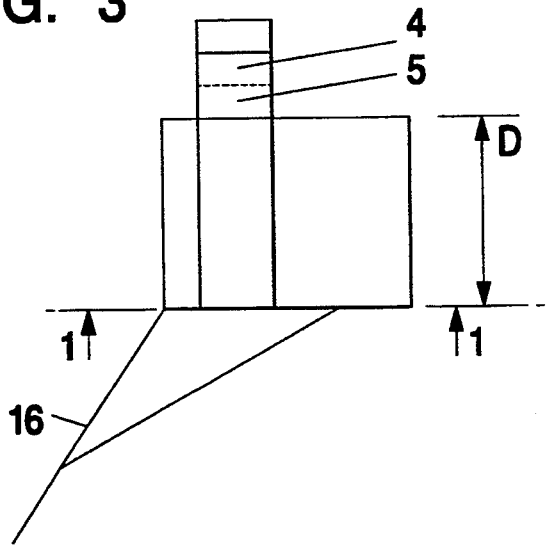
FIG. 3 shows a top view of the apparatus (open door)
Figure 5:
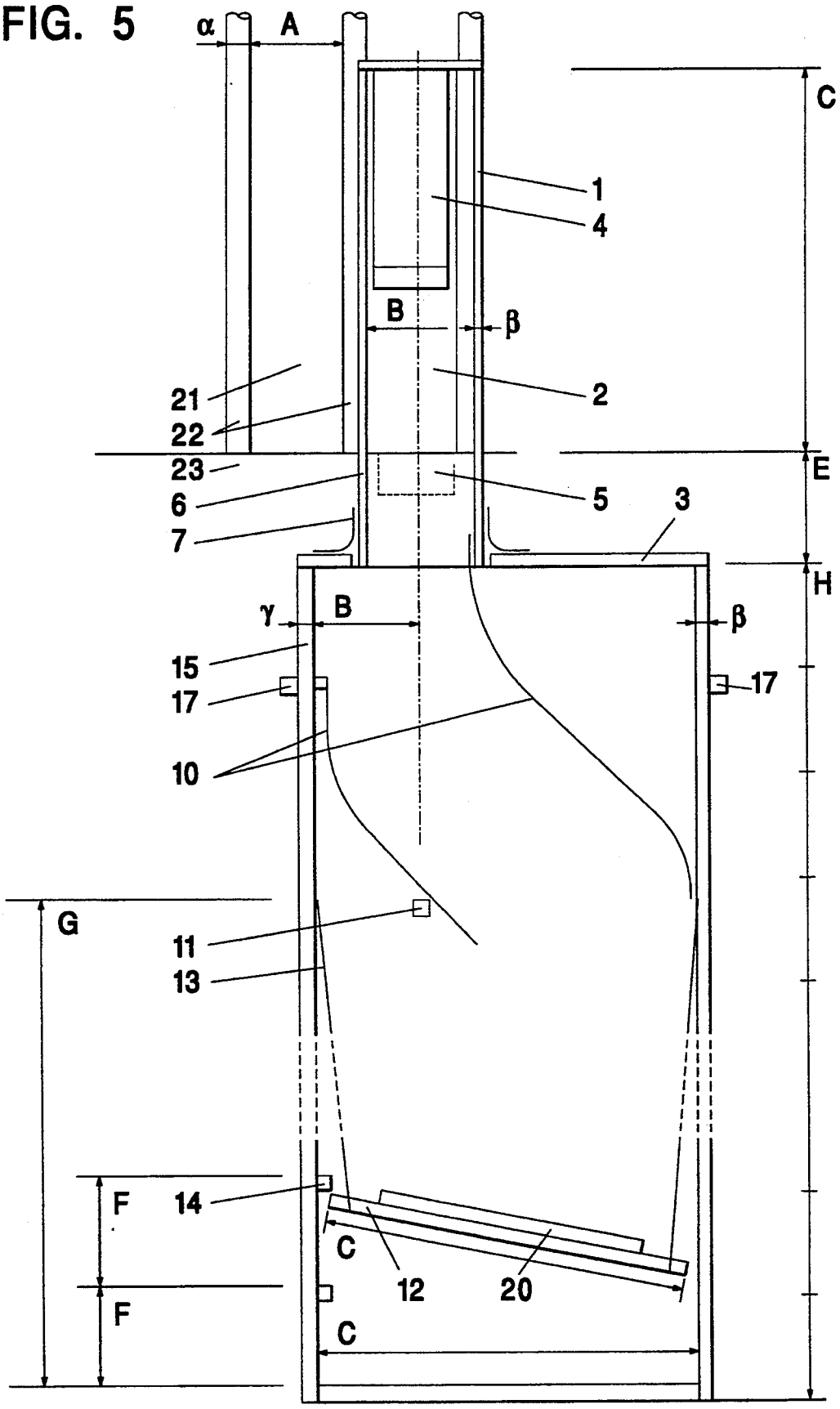
FIG. 5 shows a section of apparatus taken along the line 1—1 in FIG. 3.

According to FIG.4, the receiving box 3 can have bearing points 14 so that the receiving plate 12 can be placed on several levels: upper (minimum volume), mid or lower (maximum volume).

According to variants not illustrated, the apparatus can be of rectangular or square section. Further, the apparatus can be embedded in a wall, sealed on a concrete socle, coated with bricks or parpens to form a pillar.

Referring to the drawing, the sizes are: the distance ($\alpha$) between two openings through the gate, the breadth (A) of an opening and the cutting error ($\epsilon$).

Without excluding other possible sizes, the approximate sizes of the apparatus, which can be made of wood, metal, plastic or other materials can be, for example,:

$\gamma$=0.8 cm for thickness of the thick wall 15 (plywood)

$\beta$=0.5 cm for thickness of a thin wall (plywood)

B=A+$\epsilon$for breadth of vertical slot 2.

C=35 cm (22 to 42 cm), for height of vertical slot 2.

D=25 cm (22 to 42 cm), for inner depth of hood 1.

E=from 10 cm to several meters, for length of mail transfer conduit 6.

F=10 cm, for height of first bearing point 14.

G=F−$\epsilon$+50 cm, for height of deflector 11 (angle of 45 degrees).

H=F−E+90 cm, for height of receiving box 3.

The apparatus according to the invention is suitable in particular for the fences with vertical openings and for buildings with small entrances which require the slots of letter-boxes to be brought nearer one another and the receiving to be moved further away from one another away.

I claim:

1. In a mail receiving device for a structure having at least two rods which are oriented generally vertically and spaced apart laterally so as to define an oblong opening therebetween which extends generally parallel to said rods, the improvement comprising:

a means for attaching said device to said structure;

a hood having an oblong, narrow slot through which said mail is receivable into said hood, said slot being lengthwise aligned with said oblong opening when said device is attached to said structure by said attaching means;

a receiving box for said mail; and an elongate transfer conduit connecting said hood and said receiving box and through which said mail transfers by gravity from said hood to said receiving box.

2. The improvement as in claim 1, and further comprising: shutter means for shielding said slot in order to protect said mail from rain.

3. The improvement as in claim 1, wherein said attaching means comprises:

means for hooking said mail receiving device on said structure.

4. The improvement as in claim 1, and further comprising:

slide means for deflecting said mail laterally during said transfer by gravity.

5. The improvement as in claim 1, and further comprising:

receiving plate means, located in said receiving box, for defining a depth of fall of said mail into said receiving box.

6. The improvement as in claim 1, and further comprising:

means for suspending said receiving plate means elastically so as to cushion a fall of said mail onto said plate.

7. The improvement as in claim 1, and further comprising:

a length of said oblong slot being oriented generally vertically.

* * * * *